US011670265B2

(12) United States Patent
Shigenaga

(10) Patent No.: US 11,670,265 B2
(45) Date of Patent: Jun. 6, 2023

(54) STAND FOR MUSICAL INSTRUMENT, AND HIGH-HAT STAND

(71) Applicant: YAMAHA CORPORATION, Hamamatsu (JP)

(72) Inventor: Fumihiro Shigenaga, Hamamatsu (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 17/457,228

(22) Filed: Dec. 1, 2021

(65) Prior Publication Data

US 2022/0172698 A1 Jun. 2, 2022

(30) Foreign Application Priority Data

Dec. 2, 2020 (JP) ..... JP2020-200009

(51) Int. Cl.
*G10D 13/02* (2020.01)
*G10D 13/10* (2020.01)

(52) U.S. Cl.
CPC ..... *G10D 13/28* (2020.02)

(58) Field of Classification Search
CPC ..... G10D 13/28; G10D 13/065; G10D 13/00; G10G 5/00
See application file for complete search history.

(56) References Cited

U.S. PATENT DOCUMENTS 5,509,629 A 4/1996 Sassmannshausen et al.
2014/0097309 A1* 4/2014 Nakata ..... G10G 5/00 248/166

FOREIGN PATENT DOCUMENTS

TW M342584 U 10/2008

OTHER PUBLICATIONS

Notice of Reasons of Refusal in TW 11120231980 dated Mar 9, 202.

* cited by examiner

*Primary Examiner* — Kimberly R Lockett
(74) *Attorney, Agent, or Firm* — Chip Law Group

(57) ABSTRACT

Provided is a stand for a musical instrument, the stand including a pole in the shape of a stick extending in one direction, and a plurality of legs extending from the pole and arranged in a circumferential direction of the pole. At least one of the plurality of legs is a rotatable leg attached to the pole so as to be capable of rotating about a central axis of the pole. At least one of the plurality of legs is an offset leg held by the pole such that a longitudinal axis of the offset leg is apart from the central axis of the pole without crossing the central axis when viewed in an axial direction of the pole.

6 Claims, 6 Drawing Sheets

STAND FOR MUSICAL INSTRUMENT, AND HIGH-HAT STAND

BACKGROUND

The present disclosure relates to a stand for a musical instrument, and a high-hat stand.

U.S. Pat. No. 5,509,629 discloses a stand (cymbal stand) for a musical instrument in which at least one of a plurality of leg portions capable of being opened with respect to a pole in the center is capable of rotating about a central axis of the pole with respect to the pole.

SUMMARY

However, in the stand for a musical instrument described in U.S. Pat. No. 5,509,629, axes (i.e., longitudinal axes) of all the leg portions cross the central axis of the pole when viewed in an axial direction of the pole. Accordingly, when a given one of the leg portions has been rotated with respect to the pole to be disposed adjacent to another one of the leg portions, distal end portions of the two leg portions adjacent to each other are positioned apart from each other in a circumferential direction of the pole. Thus, the stand for a musical instrument described in U.S. Pat. No. 5,509,629 has a problem in that a limited reduction can be achieved in a setting space for the stand for a musical instrument.

In view of the above-described circumstances, the present disclosure has been conceived to provide a stand for a musical instrument and a high-hat stand which are able to achieve a reduction in a setting space.

A first aspect of the present disclosure is directed to a stand for a musical instrument, the stand including a pole, and a plurality of legs extending from the pole and arranged in a circumferential direction of the pole. At least one of the plurality of legs is a rotatable leg attached to the pole so as to be capable of rotating about a central axis of the pole. At least one of the plurality of legs is an offset leg held by the pole such that a longitudinal axis of the offset leg is apart from the central axis of the pole without crossing the central axis when viewed in an axial direction of the pole.

A second aspect of the present disclosure is directed to a high-hat stand including the stand for a musical instrument, a cymbal holder disposed at an upper end portion of the pole configured to hold an upper cymbal, a cymbal support disposed at the upper end portion of the pole under the cymbal holder configured to support a lower cymbal, and a pedal unit disposed at a lower end portion of the pole configured to move the cymbal holder.

The present disclosure is able to achieve a reduction in a setting space for a stand for a musical instrument.

DETAILED DESCRIPTION OF THE PREFERRED EMBODIMENT

Hereinafter, an embodiment of the present disclosure will be described with reference to FIGS. 1 to 7.

Figure 1:
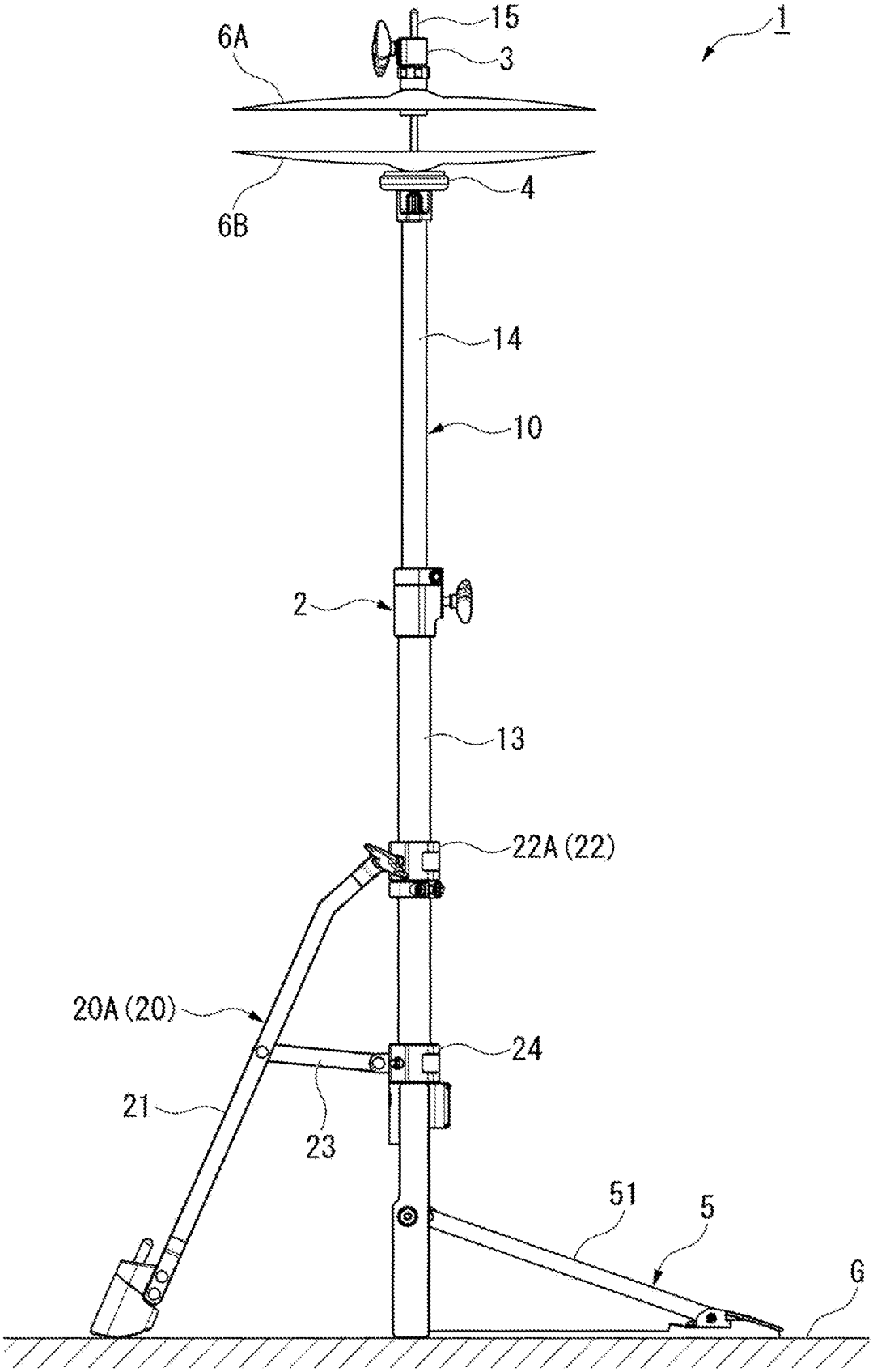
FIG. 1 is a side view of a high-hat stand according to an embodiment of the present disclosure.

Referring to FIG. 1, a high-hat stand 1 according to the present embodiment includes a stand 2 for a musical instrument, a cymbal holder 3, a cymbal support 4, and a pedal unit 5.

The stand 2 for a musical instrument includes a pole 10 and a plurality of legs 20.

The pole 10 is formed in the shape of a stick extending in one direction. As illustrated in FIG. 1, when the pole 10 is supported by the plurality of legs 20, the longitudinal direction of the pole 10 is parallel to a vertical direction. In the following description, an end portion of the pole 10 positioned on the upper side in FIG. 1 and an end portion of the pole 10 positioned on the lower side in FIG. 1 may be referred to as an upper end portion and a lower end portion, respectively.

The pole 10 includes a lower pipe 13, an upper pipe 14, and an up-down rod 15. The lower pipe 13 forms a lower end portion of the pole 10, and extends in the vertical direction. Similarly to the lower pipe 13, the upper pipe 14 extends in the vertical direction. The upper pipe 14 is inserted into the lower pipe 13 through an upper end of the lower pipe 13. The length of the pole 10 (i.e., the height of the pole 10) in the vertical direction can be adjusted by adjusting the length of a portion of the upper pipe 14 which extends upward from the upper end of the lower pipe 13. The up-down rod 15 is inserted into the lower pipe 13 and the upper pipe 14 such that a portion of the up-down rod 15 extends upward from an upper end of the upper pipe 14.

Figure 2:
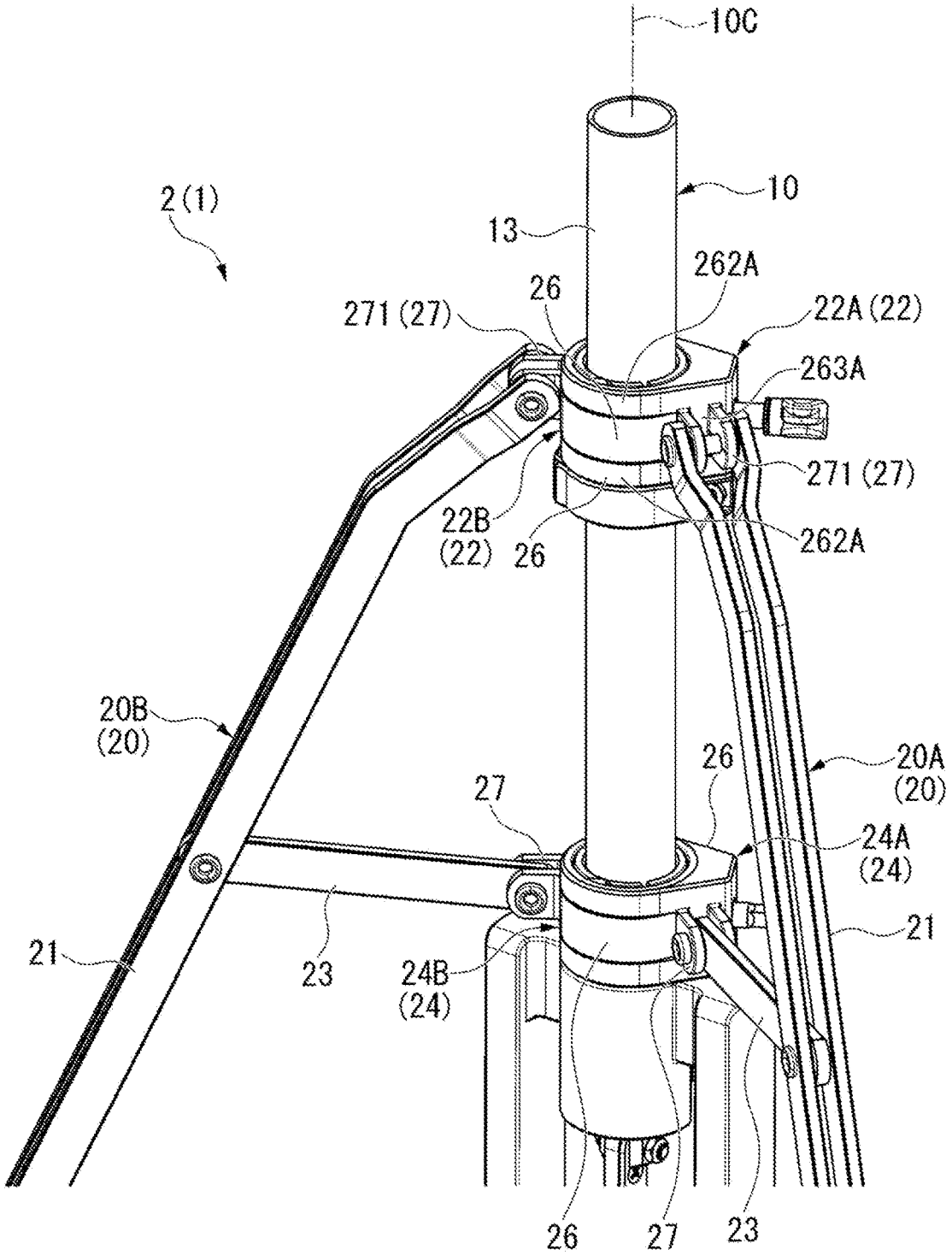
FIG. 2 is a perspective view of important portions of the high-hat stand illustrated in FIG. 1.

Referring to FIGS. 1 and 2, the plurality of legs 20 each extend from the pole 10, and are arranged in a circumferential direction of the pole 10. The plurality of legs 20 support the pole 10 such that the longitudinal direction of the pole 10 is parallel to the vertical direction when the high-hat stand 1 is placed on a ground G. While the number of the legs 20 is two in the present embodiment, the number of the legs 20 may alternatively be, for example, three or more.

Figure 6:
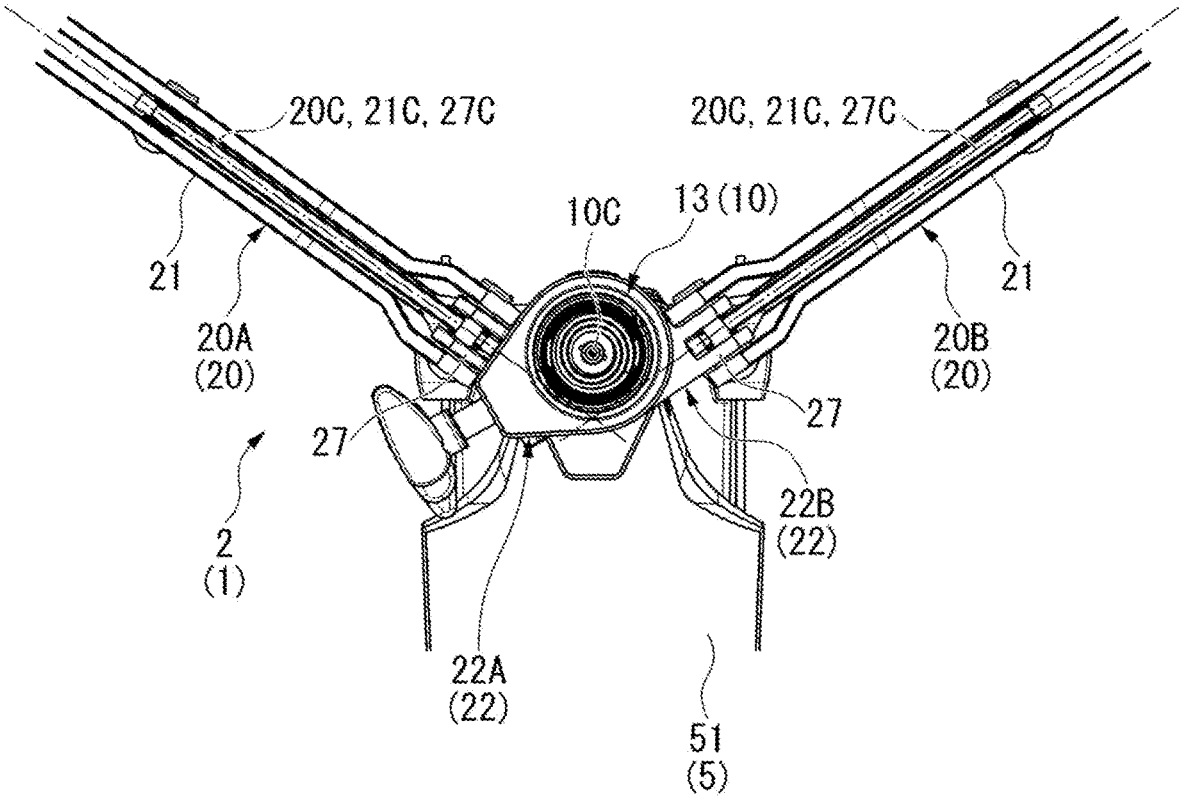
FIG. 6 is a horizontal sectional view of the high-hat stand illustrated in FIGS. 1 and 2, illustrating a state in which the two legs are positioned apart from each other in a circumferential direction of a pole.
Figure 7:
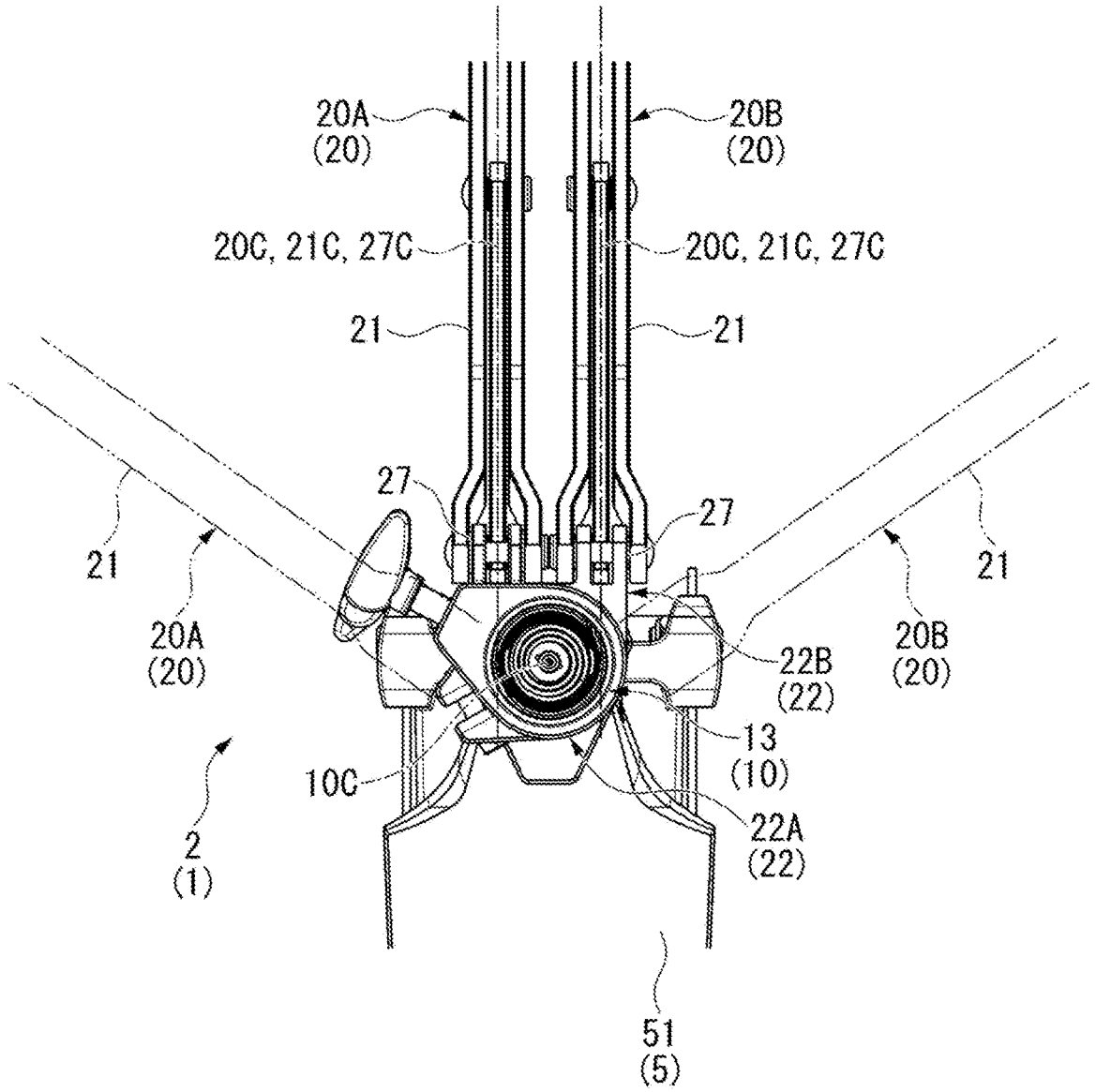
FIG. 7 is a horizontal sectional view of the high-hat stand illustrated in FIGS. 1 and 2, illustrating a state in which the two legs are positioned close to each other in the circumferential direction of the pole.

As illustrated in FIGS. 6 and 7, the two legs 20 (i.e., a first leg 20A and a second leg 20B) in the present embodiment are each a rotatable leg that is attached to the pole 10 so as to be capable of rotating about a central axis 10C of the pole 10 when viewed in an axial direction of the pole 10. In addition, each of the two legs 20 is also an offset leg that is held by the pole 10 such that a longitudinal axis (i.e., a center line 20C of the leg 20 in FIGS. 6 and 7) of the leg 20 is apart from the central axis 10C of the pole 10 without crossing the central axis 10C when viewed in the axial direction of the pole 10. That is, each of the two legs 20 serves as both a rotatable leg and an offset leg.

Specific structures of the two legs 20, each of which serves as both a rotatable leg and an offset leg, will be described below.

Referring to FIG. 2, each leg 20 includes a leg main portion 21 and a connection portion 22. In addition, each leg 20 further includes a joining stay 23 and a stay connection portion 24.

The leg main portion 21 extends from the pole 10. Specifically, the leg main portion 21 extends from an intermediate portion of the lower pipe 13, which is intermediate in the longitudinal direction of the lower pipe 13, at an angle to the axial direction of the pole 10 so as to become more distant from the pole 10 as the leg main portion 21 extends downward with respect to the axial direction of the pole 10.

Figure 3:
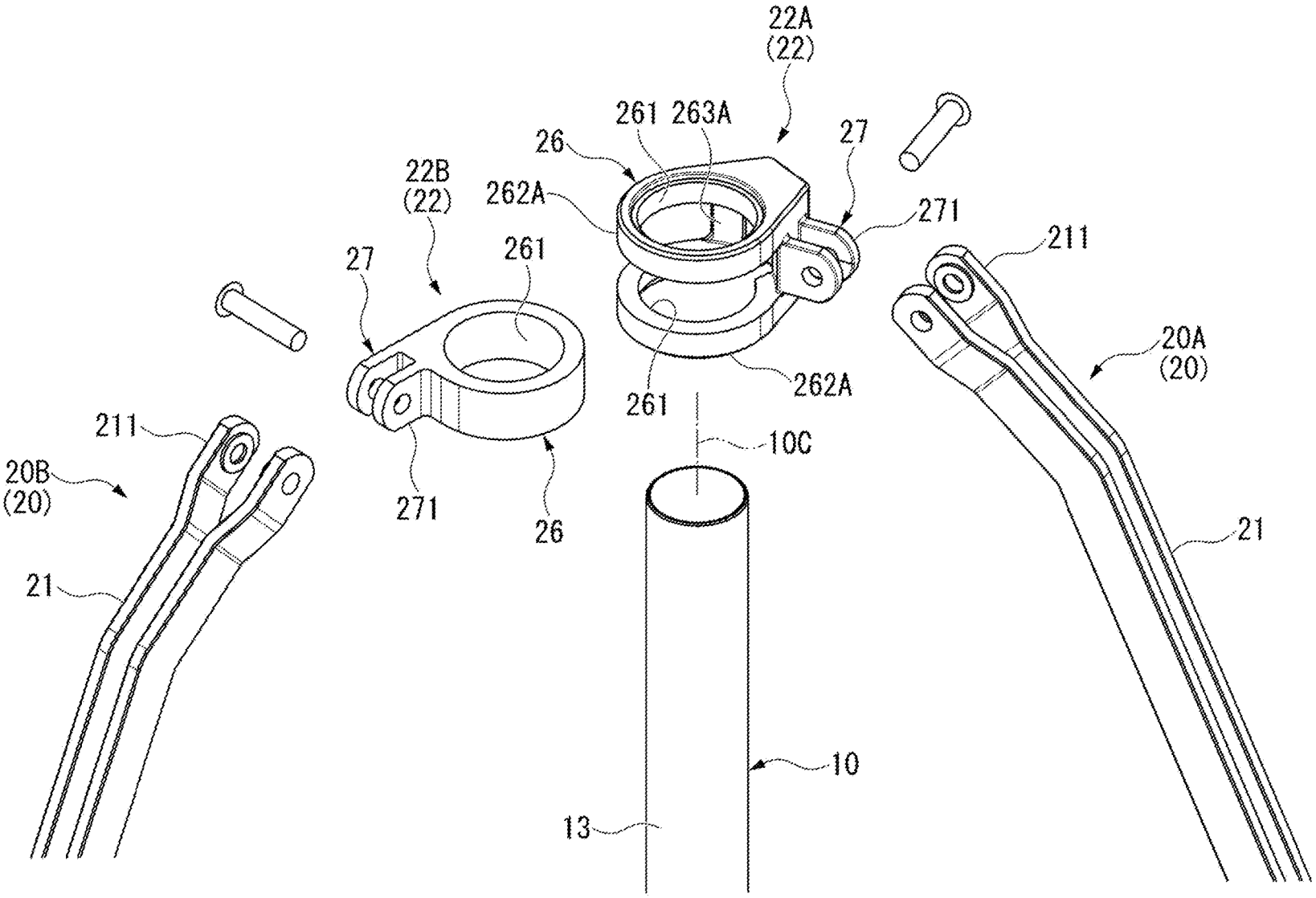
FIG. 3 is an exploded perspective view of two legs illustrated in FIG. 2.
Figure 4:
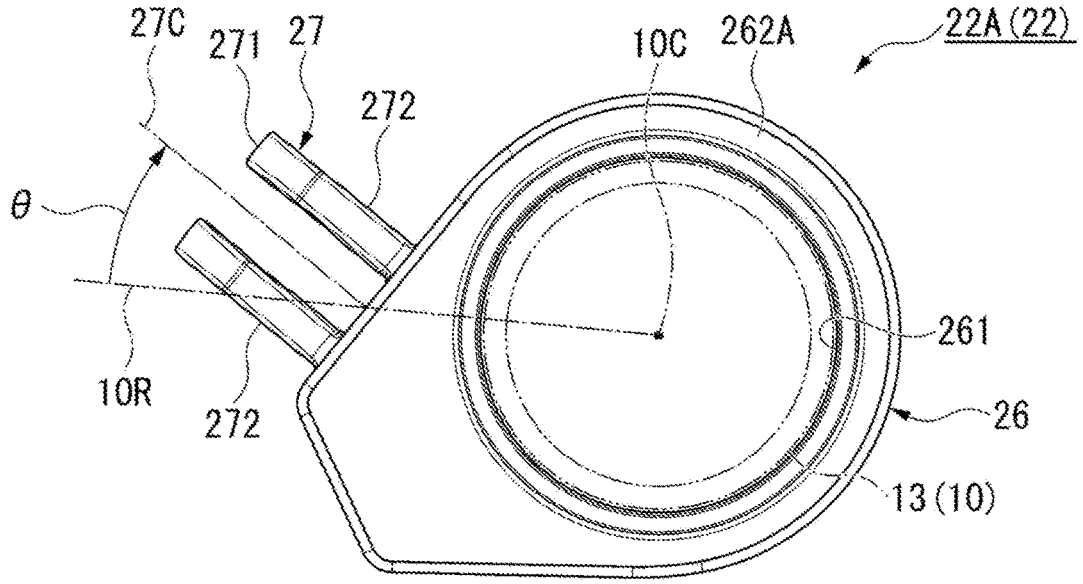
FIG. 4 is a plan view of a connection portion of a first leg.
Figure 5:
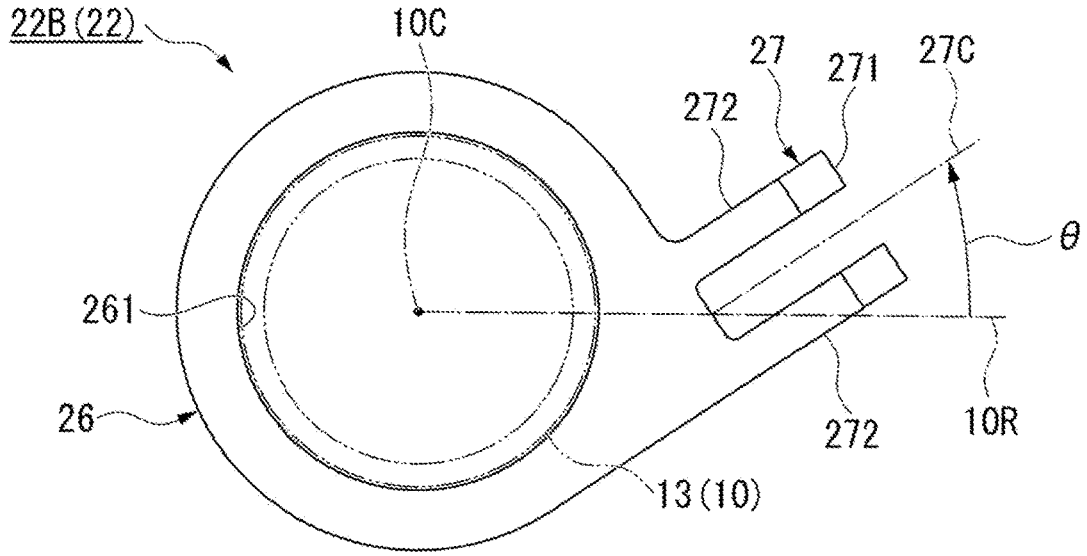
FIG. 5 is a plan view of a connection portion of a second leg.

The connection portion 22 (a first connection portion 22A and a second connection portion 22B) connects the leg main portion 21 and the pole 10 to each other. Referring to FIGS. 3 to 5, the connection portion 22 includes a bearing portion 26 and a joining portion 27.

The bearing portion 26 is attached to the lower pipe 13 of the pole 10 so as to be capable of rotating about the central axis 10C of the pole 10. The bearing portion 26 is formed in an annular shape, having an insert hole 261 through which the lower pipe 13 is passed. The insert hole 261 of the bearing portion 26 is circular, matching the lower pipe 13 which is cylindrical. Thus, the bearing portion 26 attached to the lower pipe 13 is capable of rotating about the central axis 10C of the pole 10.

The joining portion 27 is provided on a periphery of the bearing portion 26, and is joined to the leg main portion 21. The joining portion 27 extends from the periphery of the bearing portion 26 in a direction inclined with respect to a radial direction 10R of the pole 10 when viewed in the axial direction of the pole 10. An inclination angle θ of a longitudinal axis (i.e., a center line 27C of the joining portion 27 in FIGS. 4 and 5) of the joining portion 27 with respect to the radial direction 10R of the pole 10 may be greater than 0 degrees and 90 degrees or less. Thus, the longitudinal axis (i.e., the center line 27C) of the joining portion 27 is apart from the central axis 10C of the pole 10 without crossing the central axis 10C when viewed in the axial direction of the pole 10. While the joining portion 27 according to the present embodiment includes two plate-shaped portions 272 arranged side by side in a direction perpendicular to the longitudinal axis (i.e., the center line 27C) of the joining portion 27 when viewed in the axial direction of the pole 10, this may not be essential to the present disclosure.

A proximal end portion 211 of the leg main portion 21, which is positioned on a side closer to the pole 10 in the direction in which the leg main portion 21 extends, is joined to a distal end portion 271 of the joining portion 27. Referring to FIGS. 6 and 7, in a situation in which the leg main portion 21 has been joined to the distal end portion 271 of the joining portion 27, the center line 27C of the joining portion 27, which extends in the direction in which the joining portion 27 extends, and a center line 21C of the leg main portion 21, which extends in the direction in which the leg main portion 21 extends, coincide with each other when viewed in the axial direction of the pole 10. Each of the center line 27C of the joining portion 27 and the center line 21C of the leg main portion 21 constitutes the aforementioned center line 20C of the leg 20. The leg main portion 21 joined to the joining portion 27 is held by the pole 10, with the center line 21C of the leg main portion 21 being apart from the central axis 10C of the pole 10 without crossing the central axis 10C (i.e., being offset from a line that crosses the central axis 10C of the pole 10) when viewed in the axial direction of the pole 10.

Referring to FIGS. 4 and 5, in the present embodiment, the longitudinal axes (i.e., the center lines 27C) of the joining portions 27 of the two legs 20 are angled in mutually opposite directions with respect to the radial direction 10R of the pole 10. This makes it possible to bring the joining portions 27 of the two legs 20 closer to each other in the circumferential direction of the stand by rotating the connection portions 22 of the two legs 20 about the central axis 10C of the stand, and arrange the joining portions 27 of the two legs 20 such that the longitudinal axes (i.e., the center lines 27C) of the joining portions 27 of the two legs 20 are parallel to each other as illustrated in FIG. 7. It is assumed herein that "parallel" means that an angle formed by the longitudinal axes (i.e., the center lines 27C) of the joining portions 27 of the two legs 20 is 5 degrees or less.

Note that the longitudinal axes (i.e., the center lines 27C) of the joining portions 27 of the connection portions 22 of the two legs 20 may be angled in the same direction with respect to the radial direction 10R of the pole 10, for example. In this case, however, it is sufficient if the inclination angle θ of the longitudinal axis (i.e., the center line 27C) of the joining portion 27 with respect to the radial direction 10R of the pole 10 is different between the connection portions 22 of the two legs 20. Even such an arrangement allows the joining portions 27 of the two legs 20 to be arranged such that the longitudinal axes of the joining portions 27 of the two legs 20 are parallel to each other.

Referring to FIGS. 2 and 3, the bearing portions 26 of the two legs 20 are arranged in the axial direction of the pole 10. In addition, the distal end portions 271 of the joining portions 27 of the two legs 20 are disposed at the same position in the axial direction of the pole 10. These arrangements will be described specifically below.

The bearing portion 26 of the connection portion 22 (hereinafter referred to as the first connection portion 22A) of the first leg 20A of the two legs 20 includes two ring portions 262A arranged apart from each other in the axial direction of the pole 10, and a junction portion 263A provided between the two ring portions 262A to join the two ring portions 262A to each other. Each of the two ring portions 262A has an insert hole 261 through which the lower pipe 13 is passed. The junction portion 263A is provided at portions of the two ring portions 262A at a position in the circumferential direction. While one junction portion 263A is provided in the present embodiment, a plurality of junction portions 263A may be provided, for example. In this case, the plurality of junction portions 263A are arranged apart from each other in the circumferential direction of the ring portions 262A. The joining portion 27 of the first connection portion 22A extends from the junction portion 263A of the bearing portion 26. Thus, the distal end portion 271 of the joining portion 27 is positioned between the two ring portions 262A in the axial direction of the pole 10.

The bearing portion 26 of the connection portion 22 (hereinafter referred to as the second connection portion 22B) of the second leg 20B of the two legs 20 is disposed between the two ring portions 262A of the first connection portion 22A in the axial direction of the pole 10. Thus, the bearing portions 26 of the two legs 20 are arranged in the axial direction of the pole 10.

The distal end portion 271 of the joining portion 27 of the second connection portion 22B is disposed at the same position in the axial direction of the pole 10 as the bearing portion 26 of the second connection portion 22B. Thus, in a situation in which the bearing portion 26 of the second connection portion 22B is disposed between the two ring portions 262A of the first connection portion 22A, the distal end portions 271 of the joining portions 27 of the first and second connection portions 22A and 22B are disposed at the same position in the axial direction of the pole 10.

Referring to FIG. 2, the joining stay 23 of each leg 20 extends from the pole 10 to an intermediate portion of the leg main portion 21 below the leg main portion 21 to join the intermediate portion of the leg main portion 21 to the pole 10.

The stay connection portion 24 of each leg 20 connects the joining stay 23 and the pole 10 to each other. The stay connection portion 24 includes a bearing portion 26 and a joining portion 27 identical to those of the above-described connection portion 22. In addition, a stay connection portion 24A of the first leg 20A has the same structure as that of the first connection portion 22A of the first leg 20A, while a stay connection portion 24B of the second leg 20B has the same structure as that of the second connection portion 22B of the second leg 20B.

Thus, the joining stay 23 of each leg 20 can be rotated about the central axis 10C with respect to the pole 10 along with the leg main portion 21. In addition, similarly to the leg main portion 21, the joining stay 23 of each leg 20 is held by the pole 10 with a longitudinal axis of the joining stay 23 being apart from the central axis 10C of the pole 10 without crossing the central axis 10C (i.e., being offset from a line that crosses the central axis 10C of the pole 10) when viewed in the axial direction of the pole 10, although not illustrated in the figures.

Furthermore, each of the legs 20 according to the present embodiment can be folded up on the pole 10. In other words, the state of the high-hat stand 1 according to the present embodiment can be switched between an open leg state (i.e., a state illustrated in FIGS. 1 and 2) in which each leg main portion 21 extends at an angle to the axial direction of the pole 10 and a folded state (not illustrated) in which each leg main portion 21 extends along the axial direction of the pole 10.

Accordingly, the leg main portion 21 is joined to the joining portion 27 of the connection portion 22 so as to be capable of rotating about an axis perpendicular to the axial direction of the pole 10. In addition, the connection portion 22 is capable of moving in the axial direction of the pole 10 with respect to the pole 10. Furthermore, the joining stay 23 is joined to each of the leg main portion 21 and the joining portion 27 of the stay connection portion 24 so as to be capable of rotating about an axis perpendicular to the axial direction of the pole 10. Furthermore, the stay connection portion 24 is arranged not to move in the axial direction of the pole 10 with respect to the pole 10.

Here, the bearing portion 26 of the second connection portion 22B is disposed between the two ring portions 262A of the first connection portion 22A as described above. Accordingly, if the connection portion 22 of one of the two legs 20 is moved in the axial direction of the pole 10 with respect to the pole 10 to open or fold up that one of the legs 20, the connection portion 22 of the other leg 20 is moved together with respect to the pole 10. Thus, the two legs 20 can be folded up or opened at the same time.

Referring to FIG. 1, the cymbal holder 3 is disposed at the portion (i.e., the upper end portion of the pole 10) of the up-down rod 15, which is positioned above the upper end of the upper pipe 14. The cymbal holder 3 holds an upper cymbal 6A.

The cymbal support 4 is disposed at the upper end of the upper pipe 14, which forms the upper end portion of the pole 10. The cymbal support 4 supports a lower cymbal 6B on the lower side of the cymbal holder 3.

The pedal unit 5 is used to move (i.e., operate) the above-described cymbal holder 3, and is disposed at the lower end portion of the pole 10. The pedal unit 5 includes a pedal 51 capable of being pressed down. The pedal 51 is joined to the up-down rod 15 of the pole 10. The up-down rod 15 is lifted and lowered through an operation of pressing down the pedal 51. Specifically, the up-down rod 15 is lowered when the pedal 51 is pressed down. As a result, the upper cymbal 6A held by the cymbal holder 3 is lowered to strike the lower cymbal 6B supported by the cymbal support 4.

As described above, in the stand 2 for a musical instrument and the high-hat stand 1 including the same according to the present embodiment, the two legs 20 are each a rotatable leg that is attached to the pole 10 so as to be capable of rotating about the central axis 10C thereof. In addition, each of the two legs 20 is also an offset leg that is held by the pole 10 such that the longitudinal axis (i.e., the center line 20C) of the leg 20 is apart from the central axis 10C of the pole 10 without crossing the central axis 10C when viewed in the axial direction of the pole 10.

Accordingly, the two legs 20 can be rotated relative to each other about the central axis 10C of the pole 10 as rotatable legs so that the two legs 20 are arranged such that the longitudinal axes (i.e., the center lines 20C) of the two legs 20, adjacent to each other in the circumferential direction, are parallel to each other as illustrated in FIG. 7. This allows distal end portions of the two adjacent legs 20 to be positioned close to each other in the circumferential direction of the pole 10. Thus, a reduction in a setting space of the high-hat stand 1 can be achieved.

In addition, the reduction in the setting space of the high-hat stand 1 makes it easier to dispose the high-hat stand 1 (in particular, the pedal unit 5) close to a bass drum (in particular, a pedal of the bass drum).

In addition, in the high-hat stand 1 according to the present embodiment, each leg 20, which is an offset leg, serves as a rotatable leg as well. Thus, the legs 20, being offset legs, can be rotated to arrange the two legs 20 such that the two legs 20 are parallel to each other in the circumferential direction of the pole 10.

In addition, in the high-hat stand 1 according to the present embodiment, each leg 20, being an offset leg, includes the leg main portion 21, the bearing portion 26 which is attached to the pole 10 so as to be capable of rotating about the central axis 10C of the pole 10, and the joining portion 27 which is provided on the periphery of the bearing portion 26 and is joined to the leg main portion 21. In addition, the joining portion 27 extends from the periphery of the bearing portion 26 in a direction inclined in the circumferential direction of the pole 10 with respect to the radial direction 10R of the pole 10 when viewed in the axial direction of the pole 10. This enables the same leg 20 to have functions of both an offset leg and a rotatable leg.

In addition, in the high-hat stand 1 according to the present embodiment, the bearing portions 26 of the two legs 20, which are rotatable legs, are arranged in the axial direction of the pole 10. This prevents the bearing portions 26 of the two legs 20 from interfering with each other when the two legs 20 are rotated with respect to the pole 10.

In addition, in the high-hat stand 1 according to the present embodiment, the distal end portions 271 of the joining portions 27 of the two legs 20, which are offset legs, are disposed at the same position in the axial direction of the pole 10. This allows the proximal end portions 211 of the leg main bodies 21 of the two legs 20, joined to the distal end portions 271 of the joining portions 27, to be disposed at the same position in the axial direction of the pole 10. This leads to more stable support of the pole 10 by the two legs 20 than in the case where the proximal end portions 211 of the leg main bodies 21 of the two legs 20 are disposed at mutually different positions in the axial direction of the pole 10.

While an embodiment of the present disclosure has been described in detail above, the present disclosure is not limited to the above-described embodiment, and various modifications can be made to the embodiment without departing from the gist of the present disclosure.

Stands for musical instruments according to an embodiment of the present disclosure are not limited to the high-hat stand 1, and the present disclosure is applicable to stands for other musical instruments such as, for example, a stand (cymbal stand) for a suspended cymbal.

In a stand for a musical instrument according to an embodiment of the present disclosure, a rotatable leg and an offset leg may be formed by different legs 20, for example. Even with such a configuration, an advantageous effect similar to that of the above-described embodiment can be achieved.

In a stand for a musical instrument according to an embodiment of the present disclosure, it may be sufficient if at least one of a plurality of legs 20 functions as an offset leg. In other words, another leg 20, one of the plurality of legs 20 which does not function as an offset leg, may be a leg 20 (i.e., a leg 20 that is not offset) that is held by the pole 10 such that the longitudinal axis (i.e., the center line 20C) of the leg 20 crosses the central axis 10C of the pole 10 when viewed in the axial direction of the pole 10. In the case where the number of the legs 20 of the stand 2 for a musical instrument is three, one of the legs 20 may be a leg 20 that is not offset with the other two legs 20 being offset legs, for example. Even with such a configuration, an advantageous effect similar to that of the above-described embodiment can be achieved. In addition, such a configuration allows the three legs 20 to be arranged such that the longitudinal axes (i.e., the center lines 20C) of the three legs 20 are parallel to one another.

In addition, in a stand for a musical instrument according to an embodiment of the present disclosure, it may be sufficient if at least one of a plurality of legs 20 functions as a rotatable leg. In other words, another leg 20, one of the plurality of legs 20 which does not function as a rotatable leg, may be attached to the pole 10 so as to be incapable of rotating about the central axis 10C thereof. In the case where the number of the legs 20 of the stand 2 for a musical instrument is three, for example, two of the legs 20 may be incapable of rotating with respect to the pole 10, with the other one of the legs 20 being capable of rotating with respect to the pole 10. Even with such a configuration, an advantageous effect similar to that of the above-described embodiment can be achieved.

In a stand for a musical instrument according to an embodiment of the present disclosure, a leg 20 may be, for example, capable of moving with respect to the pole 10 between a position at which the leg 20 functions as an offset leg and a position at which the leg 20 does not function as an offset leg. Here, the position at which the leg 20 functions as an offset leg refers to a position of the leg 20 which causes the longitudinal axis (i.e., the center line 20C) of the leg 20 to be apart from the central axis 10C of the pole 10 without crossing the central axis 10C when viewed in the axial direction of the pole 10. Meanwhile, the position at which the leg 20 does not function as an offset leg refers to a position of the leg 20 which causes the longitudinal axis (i.e., the center line 20C) of the leg 20 to cross the central axis 10C of the pole 10 when viewed in the axial direction of the pole 10. To implement the above configuration, the joining portion 27 of the connection portion 22 may be provided so as to be capable of moving with respect to the bearing portion 26 between the above-described two positions, for example.

In addition, in a stand for a musical instrument according to an embodiment of the present disclosure, a leg 20 may be capable of being detachably attached to the pole 10 such that the leg 20 can be selectively disposed at any one of the position at which the leg 20 functions as an offset leg and the position at which the leg 20 does not function as an offset leg, for example. To implement the above configuration, the connection portion 22 may be provided with two joining portions 27 disposed at the above-described two positions to allow the leg main portion 21 to be detachably joined to one of the two joining portions 27, for example.

The present disclosure contains subject matter related to that disclosed in Japanese Priority Patent Application JP 2020-200009 filed in the Japan Patent Office on Dec. 2, 2020, the entire content of which is hereby incorporated by reference.

What is claimed is:

1. A stand for a musical instrument, the stand comprising:
a pole; and
a plurality of legs extending from the pole and arranged in a circumferential direction of the pole, wherein
a first leg of the plurality of legs is a rotatable leg attached to the pole such that the rotatable leg is rotatable about a central axis of the pole,
a second leg of the plurality of legs is an offset leg held by the pole such that a longitudinal axis of the offset leg is apart from the central axis of the pole without crossing the central axis when viewed in an axial direction of the pole,
the second leg includes:
a leg main portion extending from the pole; and
a connection portion that connects the leg main portion to the pole,
the connection portion includes:
a bearing portion attached to the pole; and
a joining portion joined to the leg main portion, and
the joining portion extends from a periphery of the bearing portion in a direction inclined in the circumferential direction of the pole with respect to a radial direction of the pole when viewed in the axial direction of the pole.

2. The stand for the musical instrument according to claim 1, wherein the offset leg serves as the rotatable leg.

3. The stand for the musical instrument according to claim 2, wherein
the bearing portion is attached to the pole so as to be capable of rotating about the central axis of the pole,
the joining portion is provided on the periphery of the bearing portion, and
the leg main portion is joined to a distal end portion of the joining portion.

4. The stand for the musical instrument according to claim 3, wherein
the plurality of legs includes at least two offset legs serving as rotatable legs,
the two offset legs include the offset leg,
bearing portions of the two offset legs are arranged in the axial direction of the pole, and
the bearing portions of the two offset legs include the bearing portion of the offset leg.

5. The stand for the musical instrument according to claim 4, wherein distal end portions of joining portions of the two offset legs are disposed at a same position in the axial direction of the pole, and the distal end portions of the joining portions of the two offset legs include the distal end portion of the joining portion of the offset leg.

6. A high-hat stand, comprising:

the stand for the musical instrument of claim 1;

a cymbal holder disposed at an upper end portion of a pole configured to hold an upper cymbal;

a cymbal support disposed at the upper end portion of the pole under the cymbal holder, wherein the cymbal support is configured to support a lower cymbal; and a pedal unit disposed at a lower end portion of the pole, wherein the pedal unit is configured to move the cymbal holder.

* * * * *